US007701395B2

(12) United States Patent
Alvey et al.

(10) Patent No.: US 7,701,395 B2
(45) Date of Patent: Apr. 20, 2010

(54) INCREASING ISOLATION BETWEEN MULTIPLE ANTENNAS WITH A GROUNDED MEANDER LINE STRUCTURE

(75) Inventors: Graham R. Alvey, Chicago, IL (US); Jennifer T. Bernhard, Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 396 days.

(21) Appl. No.: 11/710,867

(22) Filed: Feb. 26, 2007

(65) Prior Publication Data

US 2008/0204347 A1 Aug. 28, 2008

(51) Int. Cl.
*H01Q 1/38* (2006.01)

(52) U.S. Cl. ..... 343/700 MS

(58) Field of Classification Search ..... 343/700 MS, 343/909–910, 745, 752–756
See application file for complete search history.

(56) References Cited

U.S. PATENT DOCUMENTS

| | | | | |
|---|---|---|---|---|
| 6,147,572 | A | 11/2000 | Kaminski et al. | |
| 6,160,522 | A | 12/2000 | Sanford | |
| 6,184,836 | B1 | 2/2001 | Ali | |
| 6,208,219 | B1 | 3/2001 | Singer | |
| 6,218,992 | B1 * | 4/2001 | Sadler et al. | 343/702 |
| 6,346,918 | B1 | 2/2002 | Munk | |
| 6,380,895 | B1 * | 4/2002 | Moren et al. | 343/700 MS |
| 6,384,797 | B1 | 5/2002 | Schaffner et al. | |
| 6,512,487 | B1 | 1/2003 | Taylor et al. | |
| 6,518,929 | B1 | 2/2003 | Gilmore | |
| 6,538,621 | B1 | 3/2003 | Sievenpiper et al. | |
| 6,552,696 | B1 | 4/2003 | Sievenpiper et al. | |
| 6,670,921 | B2 | 12/2003 | Sievenpiper et al. | |
| 6,853,341 | B1 * | 2/2005 | Hellgren et al. | 343/742 |
| 6,856,294 | B2 | 2/2005 | Kadambi et al. | |
| 6,900,763 | B2 | 5/2005 | Killen et al. | |
| 6,914,567 | B2 | 7/2005 | Trumbull | |
| 6,952,184 | B2 | 10/2005 | Sievenpiper et al. | |
| 6,954,177 | B2 | 10/2005 | Channabasappa et al. | |
| 6,956,530 | B2 | 10/2005 | Kadambi et al. | |
| 7,030,830 | B2 | 4/2006 | Azoulay et al. | |
| 7,068,234 | B2 | 6/2006 | Sievenpiper | |
| 7,071,888 | B2 | 7/2006 | Sievenpiper | |
| 7,095,371 | B2 | 8/2006 | Monebhurrun et al. | |
| 7,106,254 | B2 | 9/2006 | Jouvie et al. | |
| 2001/0040528 | A1 | 11/2001 | Vaisanen et al. | |
| 2003/0142036 | A1 | 7/2003 | Wilhelm et al. | |
| 2004/0012530 | A1 * | 1/2004 | Chen | 343/702 |
| 2004/0125031 | A1 * | 7/2004 | Jo et al. | 343/702 |
| 2005/0179592 | A1 * | 8/2005 | Shafai et al. | 343/700 MS |
| 2005/0225496 | A1 | 10/2005 | Apostolos et al. | |
| 2006/0284770 | A1 * | 12/2006 | Jo et al. | 343/700 MS |
| 2007/0139277 | A1 * | 6/2007 | Nissinen et al. | 343/700 MS |
| 2008/0074329 | A1 * | 3/2008 | Caballero et al. | 343/702 |

* cited by examiner

*Primary Examiner*—Huedung Mancuso
(74) *Attorney, Agent, or Firm*—L. Scott Paynter; Krieg DeVault LLP

(57) ABSTRACT

A wireless communication device includes multiple antennas spaced apart from each other. Also included is a dielectric substrate with electrically conductive ground areas along the substrate opposite the antennas. Signal coupling is decreased between the antennas by connecting the ground areas together with an isolation structure. In one nonlimiting form, this structure includes an electrically conductive meander line structure.

25 Claims, 10 Drawing Sheets

INCREASING ISOLATION BETWEEN MULTIPLE ANTENNAS WITH A GROUNDED MEANDER LINE STRUCTURE

BACKGROUND

The present invention relates to antenna devices, and more particularly, but not exclusively relates to methods, systems, devices, and apparatus to increase isolation between antennas located in close proximity to one another.

There has been a growing demand for wireless communication devices that have reduced antenna bulk, faster data transfer rate, and/or less power use. In response to such demands and other considerations, many portable electronic devices, including cellular phones, laptop computers, and personal digital assistants, commonly incorporate multiple wireless communications systems into their platforms. The close proximity of communication system transceivers, and particularly corresponding antennas, can result in an undesirable degree of system performance degradation.

One approach to this problem involves the suppression of unwanted signals that reach the transceiver circuitry with self-tuning filters, adaptive cancellation, or the like. Unfortunately, once interference reaches the transceiver, it sometimes can be overwhelming. Thus, there is a need for further contributions in this area of technology.

SUMMARY

One embodiment of the present invention includes a unique technique to improve isolation between collocated (or cosited) antennas. Other embodiments include unique methods, systems, devices, and apparatus involving antenna decoupling. Further embodiments, forms, features, aspects, benefits, and advantages of the present application shall become apparent from the description and figures provided herewith.

DETAILED DESCRIPTION OF SELECTED EMBODIMENTS

Figure 1:
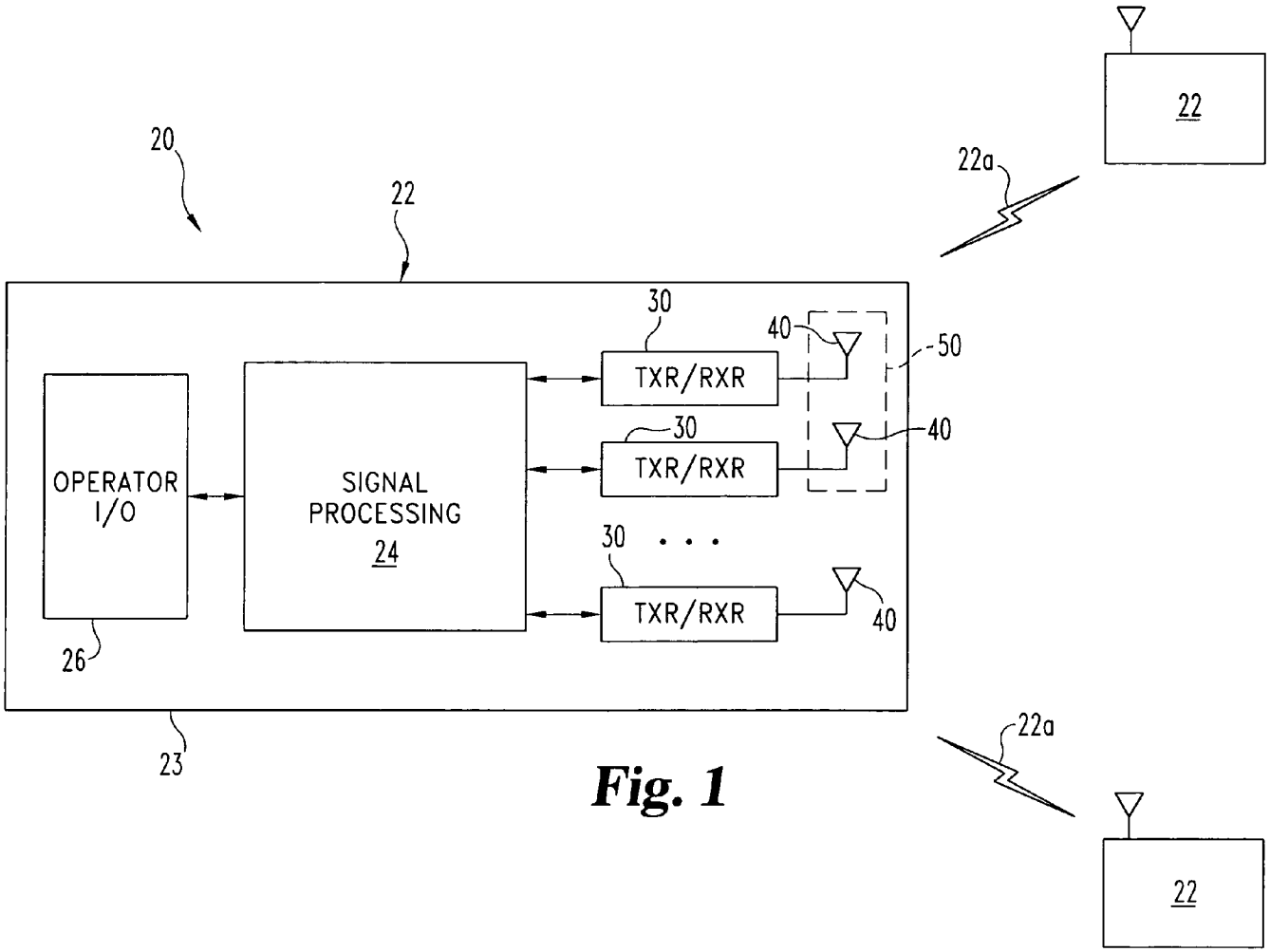
FIG. 1 is a diagrammatic view of a wireless communication device system.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

In one embodiment of the present invention, a signal isolation structure is provided to suppress coupling of signals from different antennas. This structure includes one or more electrically conductive meander line connections between electrical ground regions. These regions each correspond to one of the antennas. In one particular form, the ground regions and meander line connection(s) are defined by an approximately planar metallic layer clad to one side of a dielectric substrate and the antennas are each carried on an opposite side of the substrate.

FIG. 1 illustrates wireless communication device system 20 of another embodiment of the present invention. System 20 depicts wireless communication devices 22. Devices 22 can be of any type, including but not limited to a computer with wireless networking, a mobile telephone, a wireless Personal Digital Assistant (PDA), a video display device, and/or an audio device, just to name a few examples. Wireless communication pathways or links 22*a* are schematically shown in FIG. 1. Devices 22 are arranged to perform bidirectional communications therebetween; however, in other embodiments one or more of devices 22 may communicate in one direction only (unidirectionally).

Devices 22 each include components, programming, and circuitry suitable to its particular application. One device 22, is shown in more detail and is more specifically designated as electronic communication device 23. Device 23 includes communication signal processing circuitry 24 that is operatively coupled to operator Input/Output (I/O) 26. Circuitry 24 is configured to provide appropriate signal conditioning to transmit and receive desired information (data), and correspondingly may include filters, amplifiers, limiters, modulators, demodulators, CODECs, digital signal processing, signal format converters, and/or different circuitry or functional components as would occur to those skilled in the art to perform the desired communications.

Operator I/O 26 includes one or more input devices in the form of operator keys, switches, voice recognition/command subsystems, or the like and one or more output devices such as one or more loudspeakers, graphic displays, or the like—just to name a few representative samples of each. In still other embodiments, input and/or output devices may differ or be absent.

Device 23 includes a number of communication transceivers 30 coupled to a corresponding communication antenna 40. Each transceiver 30 includes a transmitter (TXR) and a receiver (RXR) to perform bidirectional communication with suitable Radio Frequency (RF) front end circuitry. Naturally, in unidirectional communication systems only a transmitter TXR or receiver RXR may be used, as applicable. The transmitter TXR and receiver RXR included in each transceiver 30 may be independent of one another, or at least partially combined in an integral unit.

Figure 2:
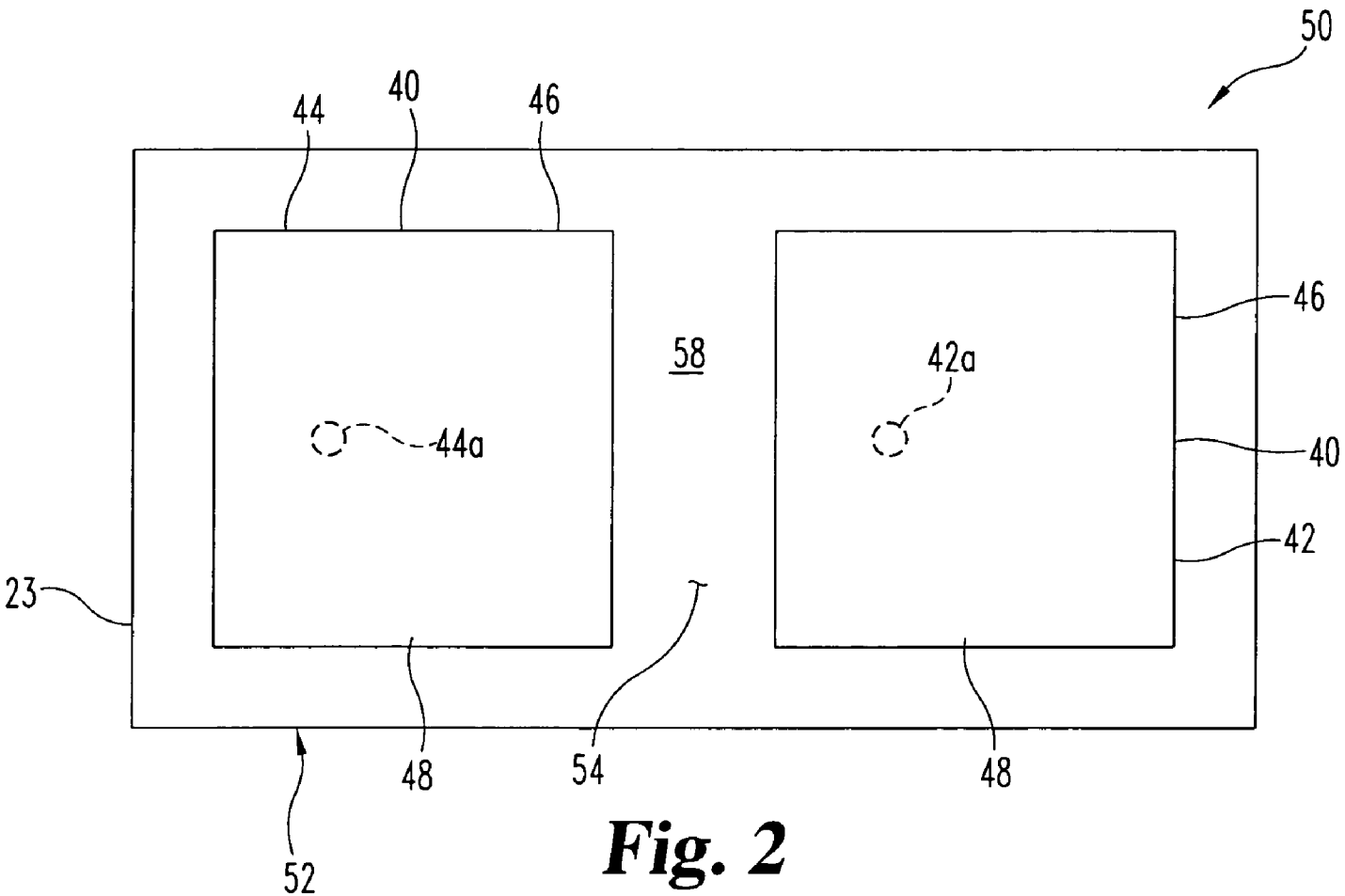
FIG. 2 is a plan view of a side of a subassembly of the system of FIG. 1 that includes multiple antennas.
Figure 3:
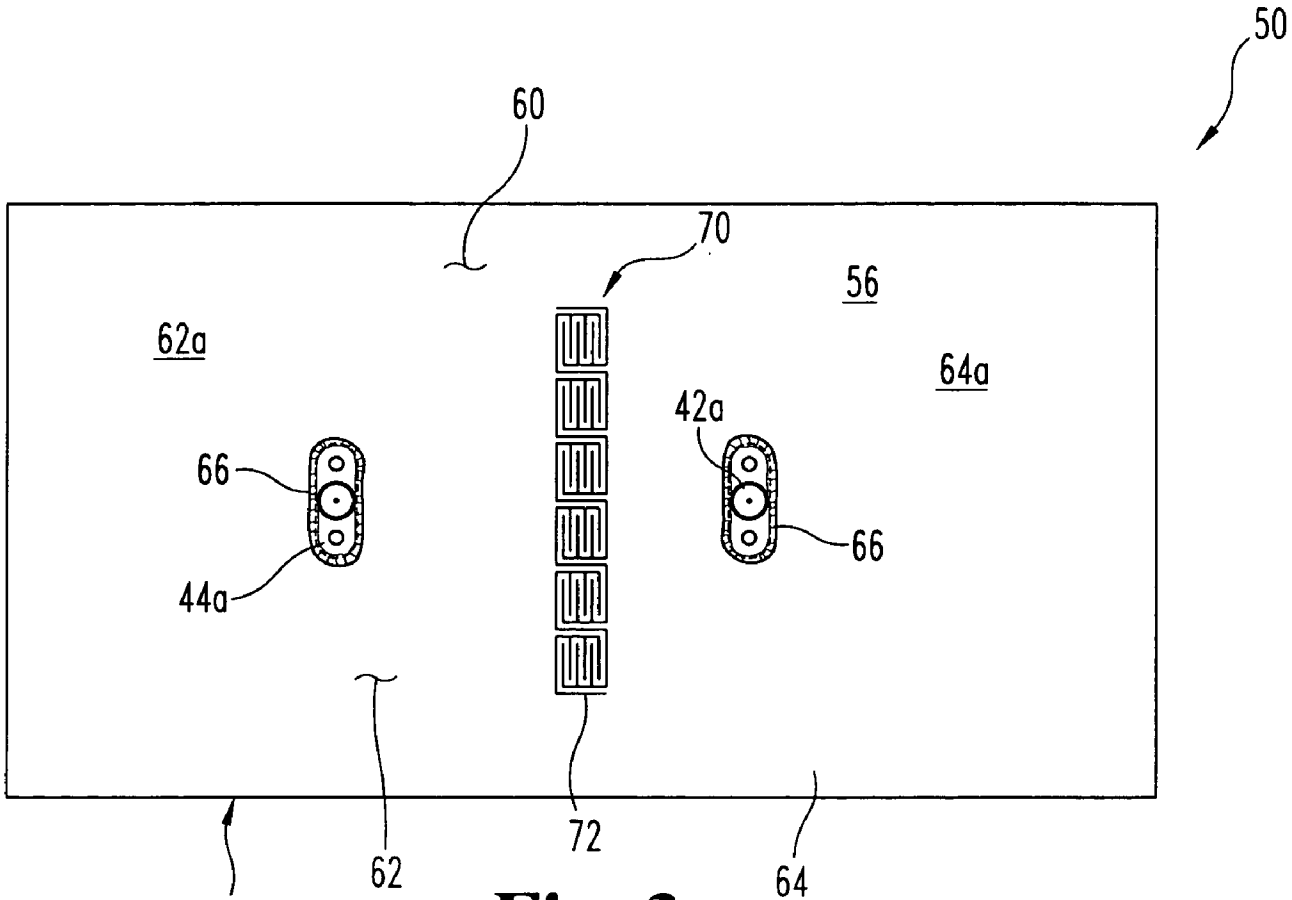
FIG. 3 is a plan view of another side of the subassembly opposite the side shown in FIG. 2.
Figure 4:
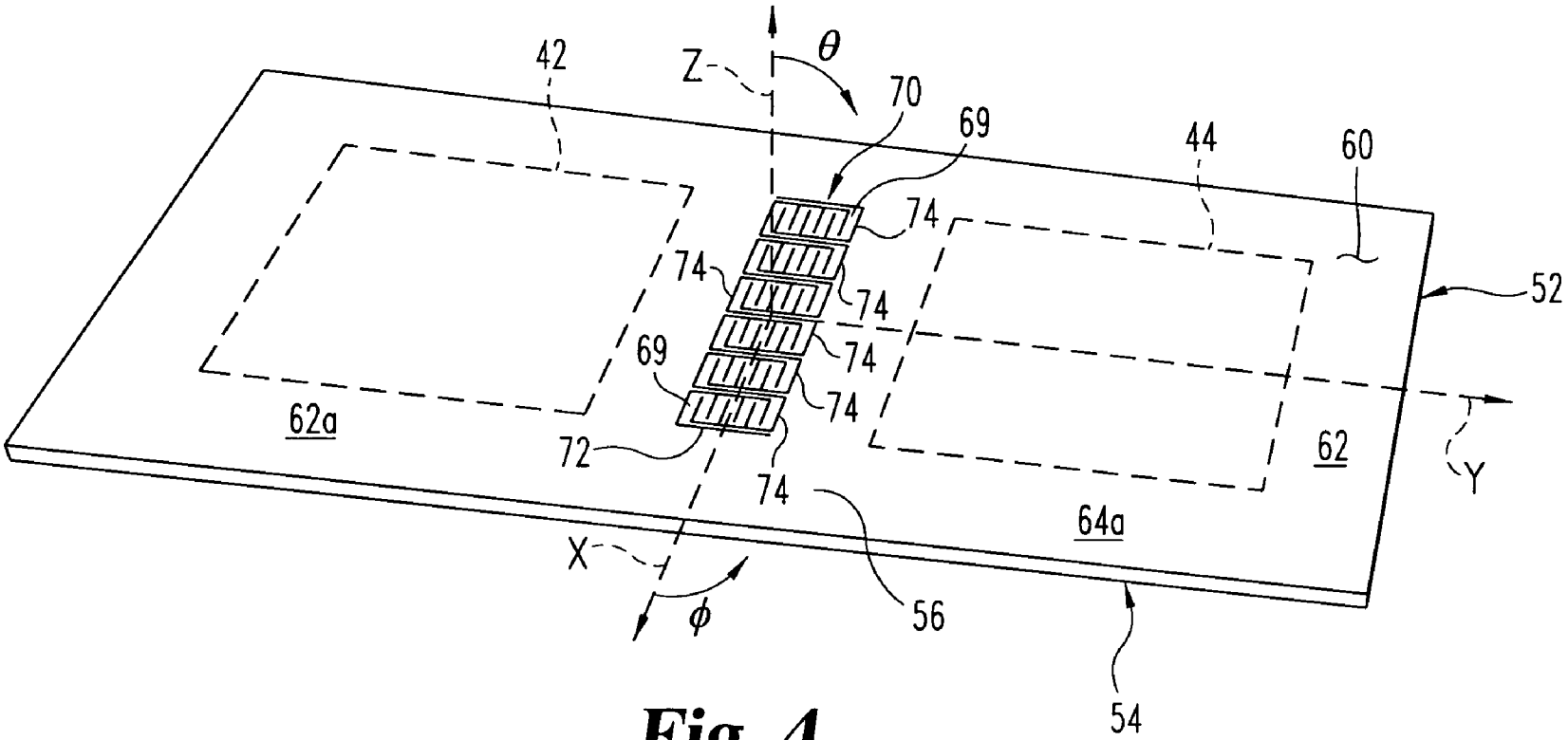
FIG. 4 is a perspective view of the subassembly of FIG. 2.

The presence of multiple antennas 40 in device 23 can pose a greater chance of interference/noise that may degrade system performance. The coupling of surface waves from different antennas are among the possible mechanisms that can cause such degradation. Referring additionally to FIGS. 2-4, an antenna subassembly 50 is depicted that is structured to reduce coupling and correspondingly improve signal isolation between antennas 40. In FIGS. 2-4, two antennas 40 are more specifically designated as antenna elements 42 and 44. As shown in FIG. 2, antenna elements 42 and 44 are each depicted in the form of a microstrip patch antenna 46 with an electrically conductive layer member 48. Layer member 48 is generally planar. Many other geometries are possible, but layer member 48 is rectangular in shape in this implementation. Subassembly 50 includes an electrically dielectric substrate 52. Substrate 52 includes side 54 opposite side 56. Antenna elements 42 and 44 are carried on substrate 52, and are spaced apart from one another along side 54, with a dielectric gap region 58 therebetween.

In FIG. 3, side 56 is further depicted. Side 56 is clad with an electrically conductive layer 60 to provide an electrical ground 62 opposite antenna elements 42 and 44. Ground 62 is approximately coextensive with side 56 of substrate 52 to define a form of ground plane 64. Subassembly includes coaxial through-hole connections 42*a* and 44*a* for antenna elements 42 and 44, respectively, to provide corresponding RF signal ports 66. In FIG. 2, connections 42*a* and 44*a* are shown in phantom. Ground 62 includes a generally contiguous, electrically conductive area 62*a* about connection 42*a* and a generally contiguous, electrically conductive area 64*a* about connection 44*a*.

Figure 5:
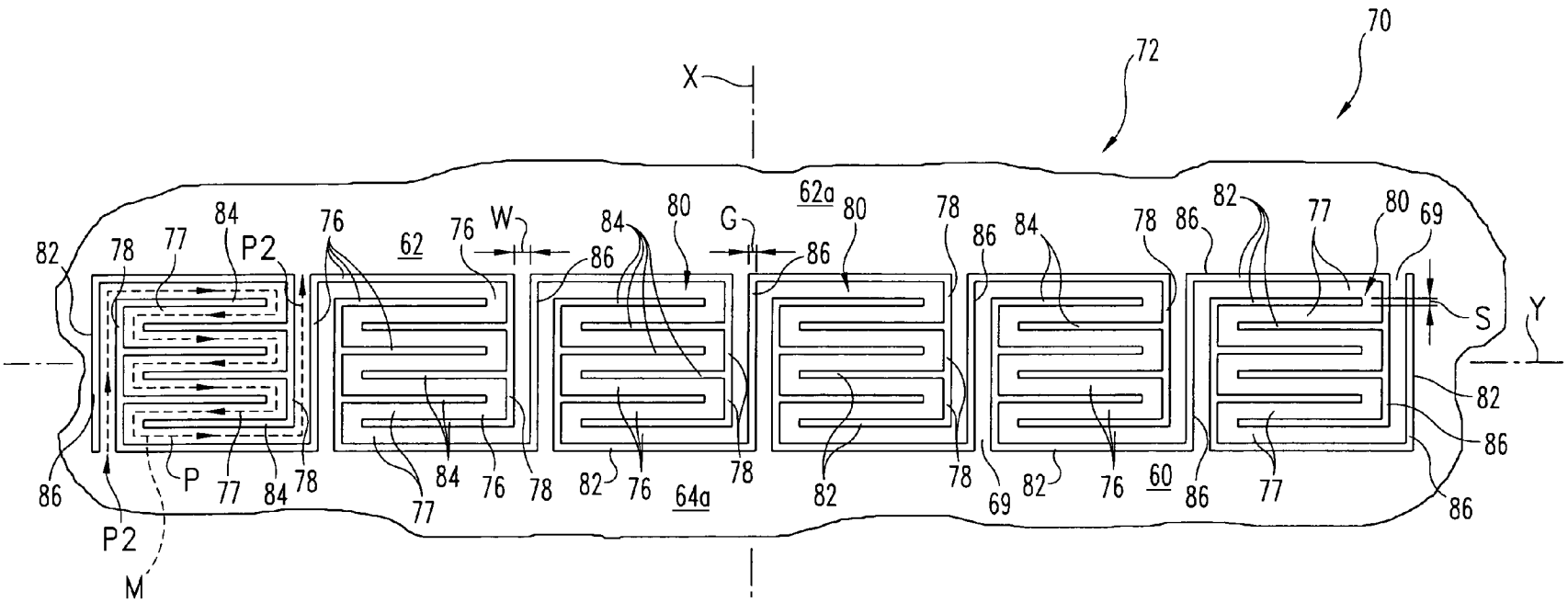
FIG. 5 is a view of the signal isolation structure shown in FIGS. 3 and 4.

Subassembly 50 also includes antenna isolator 70 in the form of a surface wave decoupler 72 defined by layer 60. The perspective view of FIG. 4 depicts that isolator 70 positioned between areas 62*a* and 64*a* and opposite gap region 58 between elements 42 and 44. In FIG. 4, the borders of antenna elements 42 and 44 are shown in phantom because they are on the hidden side 54 of substrate 52 in this view. Also, the connections 42*a* and 44*a* have not been shown to preserve clarity. For directional reference, mutually perpendicular Cartesian axes are shown—specifically depicted as the x-axis, y-axis, and z-axis in FIG. 4. Also, angular designators θ and ϕ are shown for future reference. Referring further to FIG. 5, isolator 70 includes a number of meander line structures 74. Six meander line structures 74 are shown in the illustrated example. Structures 74 each include several legs 76 including elongate leg segment elements 77 connected by shorter connecting segment elements 78 to define corresponding switchbacks 80. Correspondingly, structures 74 following a meander line pathway M with switchbacks 80 providing for several direction reversals in a boustrophedonic manner, as the pathway progresses along the x-axis from point P1 to point P2. The length of meander line pathway M between points P1 and P2 is designated as pathway length P. Only a few of legs 76, elements 77, elements 78, and switchbacks 80 have been designated in FIG. 5 by reference numerals to preserve clarity.

To define structures 74, layer 60 includes voids 82 that surround legs 76. Voids 82 include a number of dielectric slots 84 that interdigitate with elongate elements 77 to provide separation therebetween. Voids 82 provide a break in electrical continuity between structures 74, and define corresponding dielectric separating gaps 86. Only a few of voids 82, slots 84, and gaps 86 are specifically designated in FIG. 5 to preserve clarity. Each structure 74 provides an electrically conductive connection between area 62*a* and 64*b* to establish electrical continuity therebetween. In FIG. 5, the meander line structure 74 line width is designated by "W," the void separation between elongate elements 77 is designated by "S," and the dielectric gap width between meander line structures 74 is designated by "G." Further, it should be appreciated that as depicted, the structures 74 constitute an electrically grounded meander line portion 69 of ground 62.

In certain applications, it has been discovered that structures 74 can be arranged to provide frequency selectivity with respect to common surface wave coupling between antennas along a dielectric substrate. The meandered-line configuration can be modeled as a periodic array of elements that are each approximately half of a wavelength in length with respect to a signal wavelength of interest such as that of a carrier frequency for RF communications, while using an average between the permittivity of air and the permittivity of the substrate. Observing that a surface wave can radiate, it was discovered that it is possible to redirect the surface waves guided along the substrate into broadside radiation. Accordingly, structure 74 can provide meandered-line frequency selectivity as a parasitic array by providing such radiation redirection. In other words, the dielectric substrate serves as a waveguide and the meander line structures 74 redirect surface wave radiation along this waveguide to become backside broadside radiation so that coupling between antenna elements 42 and 44 is decreased.

It can be shown that the scan impedance at the grazing angle in a dielectric-backed frequency selective surface potentially can be large as described by B. Munk in *Frequency Selective Surfaces Theory and Design*, (New York, John Wiley & Sons, 2000). Considering a free space, bandstop frequency selective surface of electric dipoles, the real part of the scan impedance can be simplified as expressed in equations (1) and (2) that follow:

$$R_A = \frac{Z}{2D_X D_Y}\frac{\Delta\ell^2}{\cos\theta} \quad \text{for } \phi = 90°,\ P_\perp \text{ plane} \tag{1}$$

$$R_A = \frac{Z}{2D_X D_Y}\Delta\ell^2\cos\theta \quad \text{for } \phi = 0°,\ P_{||} \text{ plane} \tag{2}$$

where: Z is the individual element impedance, $D_X$ and $D_Y$ are the interelement spacings along the respective x-axis and y-axis, Δl represents a scalar pattern factor of the element, and the variables θ and ϕ represent angles as shown in FIG. 4. Though the scan impedance of equations (1) and (2) are for electric dipoles, the same approach translates to magnetic dipoles as well. Replacing the electric dipoles with magnetic dipoles and switching the incident electric field to an incident magnetic field, the equations remain the same. The magnetic complement applies well to the meandered-line configuration because the slots 84 created in the ground plane 64 couple to the magnetic field of the surface wave. The $TM_0$ mode surface wave created by the microstrip patch antennas would represent an incident plane wave propagating in the y direction, with an x-directed magnetic field. This arrangement corresponds to the conditions: ϕ=90° and θ=90°. Because the inverse of cos θ approaches infinity as θ approaches 90°, $R_A$ also approaches infinity. Therefore, the meander-line structure generates a high-impedance surface for the surface wave.

A circuit model can also be used to evaluate structure 74. As the surface current goes through each elongate leg segment element 77, the phase is typically delayed analogous to an inductor. Also, each short connecting segment element 78 is bounded by a gap filled with an equivalent air-substrate dielectric, which is analogous to loading with a parallel capacitance. To account for radiation loss, parallel resistances can be inserted. Accordingly, for this model the elongate elements 77 of the meander line structure 74 each resemble a parallel RLC network with such elements 77 being capacitively coupled to each other. This configuration corresponds to a form of bandstop filter. Naturally in other embodiments, different behavior and/or modeling of the device may be applicable.

Moreover, many different embodiments of the present application are envisioned with different applications and implementations. For example, in other applications more than two antennas are isolated by utilizing one or more electrically grounded meander line structures therebetween. Alternatively or additionally, the grounded meander-line structure is utilized in other examples to address different mechanisms of interference, noise, wave coupling, or the like. In still another example, different antenna types besides patch antennas are isolated/decoupled by application of meander line structures. In yet other embodiments, a meander line structure or equivalent thereto is provided in a nongrounded, electrically conductive structure to provide a desired level of decoupling and/or isolation. In a further embodiment, one or more passive or active elements are incorporated into the meander line structure (grounded or otherwise) to further decoupling and/or isolation. In still further examples of other embodiments, a different number of meander line structures, a different number of elongate elements in a given meander line structure, and/or different sizing/shaping of the meander line structure is utilized. In yet further embodiments, a number of slots are formed in a ground plane between contiguous regions opposite the space between the antenna elements without an interconnecting meander line to provide isolation in lieu of at least some meander line structures. For one nonlimiting form, these slots are generally parallel to one another with a longitude extending transverse to an expected direction of surface wave propagation.

In one mode of manufacturing the subassembly 50, layer 60 is deposited on side 64 in accordance with a pattern that defines voids 82 using photolithographic techniques. Alternatively or additionally, voids 82 can be made by removing a portion of layer 60 already deposited by etching or other selective removal process. Antenna elements 42 and 44 can be fabricated in a like manner with respect to side 54. In still other embodiments, at least a portion of ground 62 is defined by a different layer or member than another portion of ground 62. In yet a further embodiment, ground 62 is provided on a flexible or semi-rigid substrate that can be curved or bent, as in the case standard flex-print devices to name just one possible alternative. In a different implementation, the substrate carrying the meander line structure is nonplanar and has a rigid, semi-rigid, or nonrigid character.

In another embodiment, an apparatus comprises a wireless communication device that includes a dielectric substrate and an electrical ground plane defined on a first side of the substrate. This ground plane defines several contiguous electrically conductive areas along the first side of the substrate, and an electrically grounded meander line portion electrically coupled to a first one of the areas and a second one of the areas to provide electrical continuity therewith. The meander line portion includes several legs each separated from the next by a corresponding dielectric slot to provide isolation between surface wave signals traveling along the substrate from one of the first area and the second area to another of the first area and the second area.

A further embodiment includes a wireless communication device with a dielectric substrate, two or more antenna elements spaced apart from one another along one side of the substrate, and an electrical ground region carried on an opposing side of the substrate. The electrical ground region includes a first electrically conductive area opposite a first one of the antenna elements and a second electrically conductive area opposite a second one of the antenna elements. Furthermore, the ground region defines an electrically conductive meander line structure interconnecting the first area and the second area that extends along the substrate opposite a portion on the other side of the substrate positioned between a first one of the antenna elements and a second one of the antenna elements.

Yet, another embodiment includes: operating a wireless communication device comprising a first antenna, a second antenna spaced apart from the first antenna, and a dielectric substrate, the substrate including a first electrically conductive ground area along the substrate opposite the first antenna and a second electrically conductive ground area along the substrate opposite the second antenna; and suppressing signal coupling between the first antenna and the second antenna by connecting the first area and the second area to an electrical ground structure to provide electrical continuity therewith, the structure extending along the substrate opposite a region between the first antenna and the second antenna, the structure defining a meander line with multiple legs.

Yet a different embodiment of the present application includes: providing a dielectric substrate for an electronic device; defining an electrical ground region on a first side of the dielectric substrate with a first contiguous area and a second contiguous area; defining a number of dielectric slots along the first side of the substrate between the first area and the second area, the slots being separated from one to the next by a corresponding electrically conductive, grounded pathway in electrical continuity with the first area and the second area; and positioning the slots in the corresponding grounded pathway to suppress surface wave coupling between the first area and the second area.

Still another embodiment of the present application includes a dielectric substrate for an electronic device and means for defining an electrical ground region on a first side of the dielectric substrate with a first contiguous area and a second contiguous area, means for defining a number of dielectric slots along the first side of the substrate between the first area and the second area with the slots being separated from one to the next by a corresponding electrically conductive grounded pathway in electrical continuity with the first and second areas, and means for positioning the slots and the corresponding grounded pathway to suppress surface wave coupling between the first area and the second area.

Still a further embodiment of the present application is directed to an apparatus that comprises a wireless communication device. This device includes a dielectric substrate, and an electrical ground region defined on a first side of the substrate. The ground region includes a first contiguous electrically conductive area, a second contiguous electrically conductive area, and a number of spaced apart electrical ground interconnecting portions to decrease coupling of surface waves along the substrate. Each of these portions includes an electrical connection with the first area and an electrical connection with the second area to provide electrical continuity therewith, several connected legs to define a pathway with a number of turns between the first area and the second area, and a number dielectric voids in the ground region to separate the legs from one to the next.

EXPERIMENTAL RESULTS

A multiple antenna device was fabricated according to subassembly 50. This device was evaluated by simulation and empirical testing. For these experiments, the substrate was ROGERS DUROID 5880, which has a relative permittivity of 2.2. Standard copper cladding was used to define the antenna elements and ground layer. The corresponding effective permittivity was 1.6. For the illustrated patch antenna configuration, an operating frequency of 2.38 GHz was selected, which led to a design target resonant 0.48λ length of approximately 47.8 millimeters (mm) at the operating frequency under ideal conditions. For simulation and empirical testing, the dimensions of the device relative to the subassembly 50 description are set forth in Table I as follows:

TABLE I

| Dimension Description | Figure Reference | Value in millimeters (mm) |
|---|---|---|
| Substrate width along x-axis | FIG. 4 | 83.38 mm |
| Substrate length along y-axis | FIG. 4 | 140.56 mm |
| Substrate thickness along z-axis | FIG. 4 | 1.575 mm |
| Patch antenna x-y dimension | FIG. 4 | 49.38 mm × 40.78 mm |
| Distance between patch antennas along y-axis | FIG. 4 | 25 mm |
| Meander line isolator length along x-axis | FIGS. 4 & 5 | 45.9 mm |
| Meander line isolator width along y-axis | FIGS. 4 & 5 | 6 mm |
| Path length P of an individual Meander line | FIG. 5 | 47.8 mm |
| Meander line width W | FIG. 5 | 0.5 mm |
| Separation S between elongate elements | FIG. 5 | 0.317 mm |
| Gap width G between meander line structures | FIG. 5 | 0.3 mm |
| Outer Gap Dimension along x-axis | FIG. 5 | 6 mm |
| Outer Gap Dimension along y axis | FIG. 5 | 7.6 mm |

Figure 6:
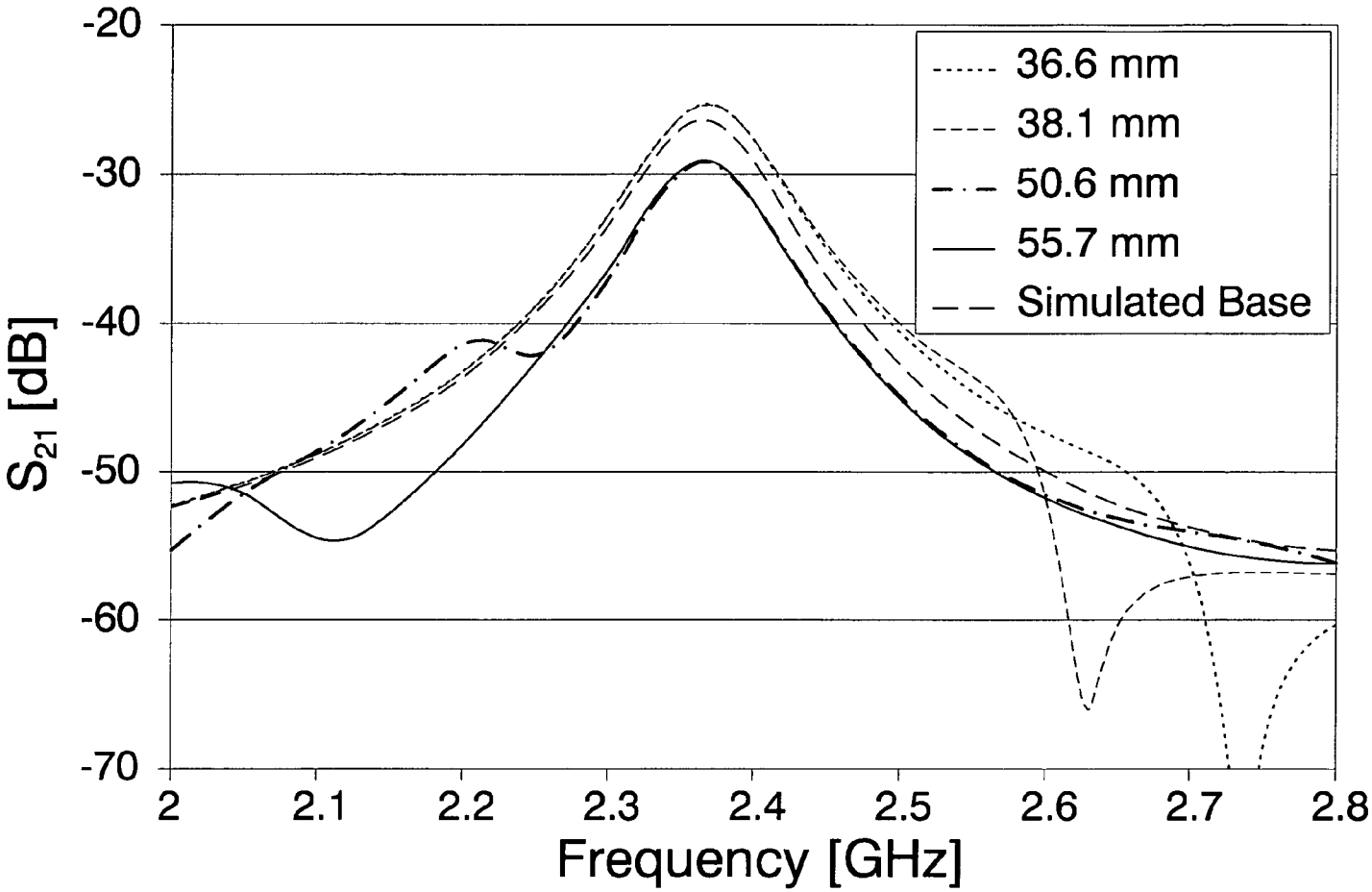
FIG. 6 is a graph of simulated signal coupling ($S_{21}$ parameter) as it varies with meander line path length.

Multiple parametric simulation studies were performed using ANSOFT HFSS v9.2. For the simulated configuration, it was observed that the total meandered line path length P determined the frequency of the bandstop. When the overall meandered-line element path length P coincided with a resonant effective half wavelength for a given frequency, that frequency exhibited a decrease in the coupled signal parameter $S_{21}$. The comparative plots of FIG. 6 depict this dependency, in which the element path length P was varied by simulation. In FIG. 6, the simulated base plot is representative of a continuous ground plane without an isolation structure.

Figure 7:
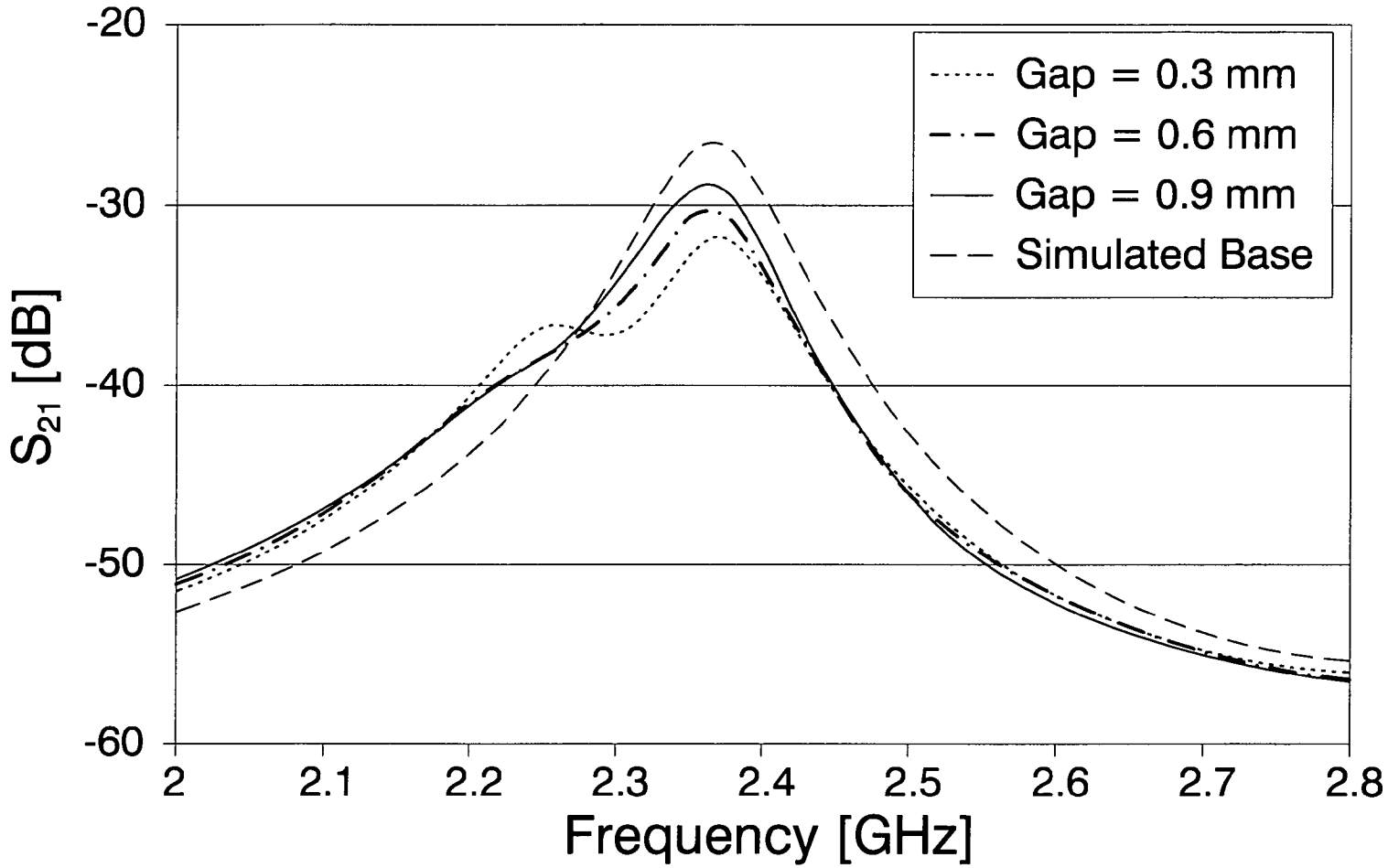
FIG. 7 is a graph of simulated signal coupling ($S_{21}$ parameter) as it varies with gap size.

Another observation from simulation was that the gap width between adjacent meandered-line elements influenced the amount of decrease in the $S_{21}$ parameter, such that a wider gap led to poorer isolation relative to a narrower gap. The comparative plots of FIG. 7 correspond to different interelement gap widths with respect to the elongate elements while the meandered line path length P remains constant. In accord with either the scan impedance or the circuit model, as the gap width increases $D_X$, it reduces the level of impedance that can be achieved. The circuit model suggests that the elongate leg segments with a small interelement capacitance better subjects surface current from a surface wave to meander line conduction instead of travel across the gap. In contrast, larger gap widths increases capacitance, lowering high frequency impedance, which better promotes gap travel.

Figure 8:
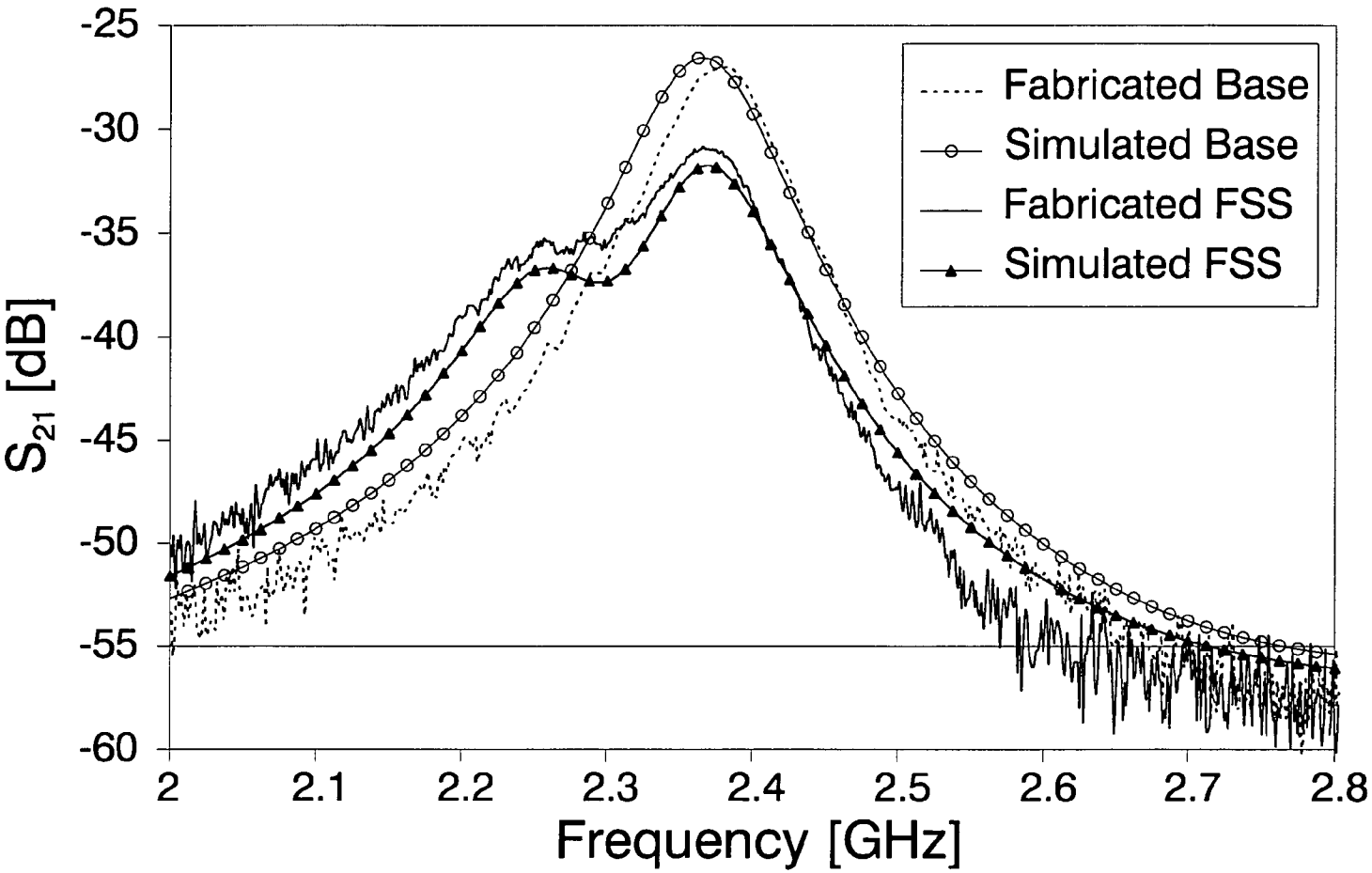
FIG. 8 is a graph of signal coupling ($S_{21}$ parameter) from empirical testing.
Figure 9:
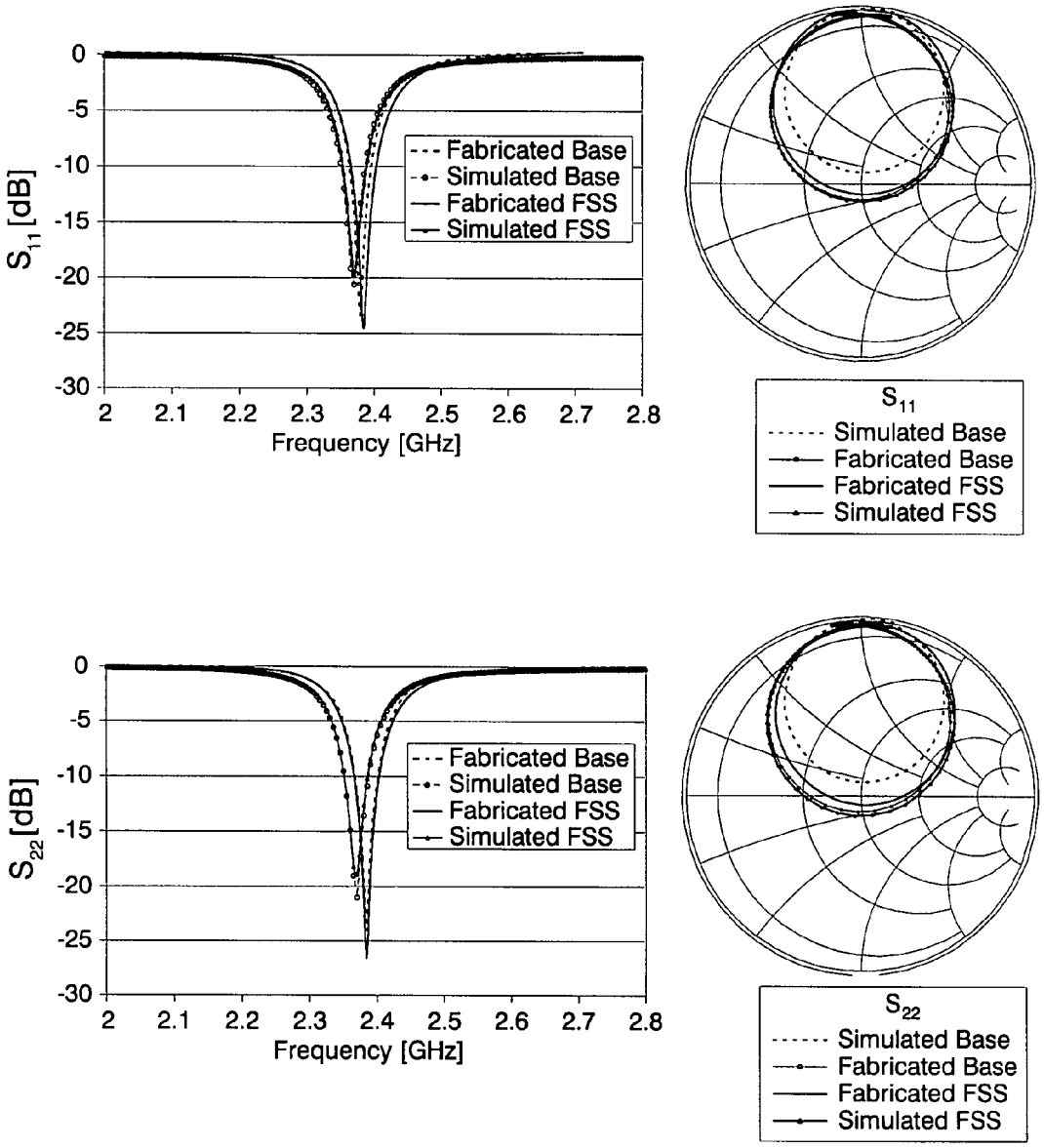
FIG. 9 shows comparative graphs of frequency response and smith charts for $S_{11}$ and $S_{22}$ parameters from empirical testing.
Figure 10:
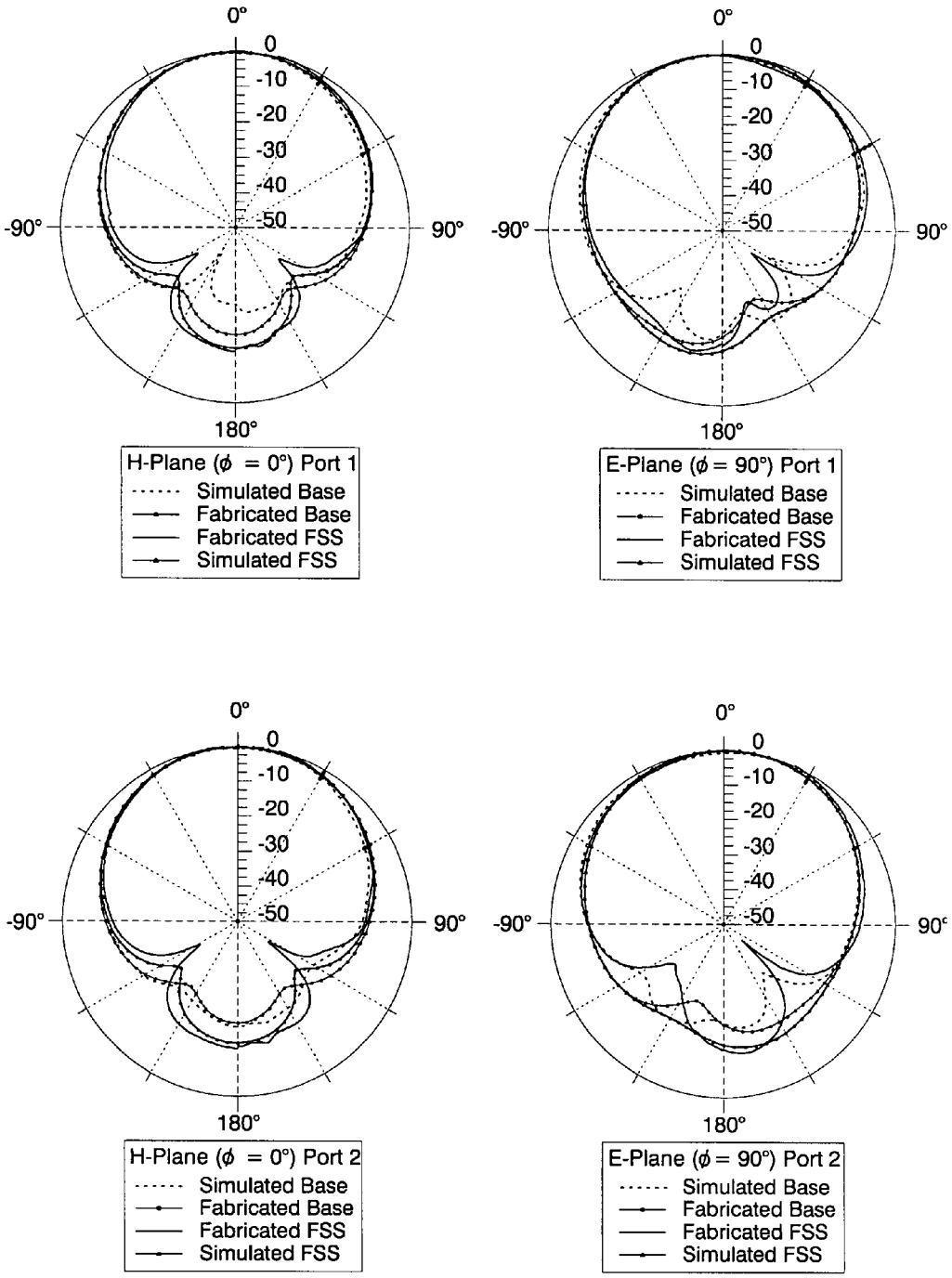
FIG. 10 shows comparative graphs of H-Plane and E-Plane radiation patterns for the subassembly from empirical testing.

During fabrication of a first version of the device, a fraction of a centimeter of dielectric as well as the copper ground plane was removed during milling of the ground plane that resulted in each meander line element appearing electrically shorter than designed. To counteract this shortcoming in the milling process, a second version of the device was fabricated in which the meander line path length was extended to 49.9 mm and the total array length was extended to 47.7 mm instead of the 47.8-mm path length and the 45.9-mm array length of initial design targets. The experimentally measured S parameters compared to the simulation results and the continuous ground plane base line configuration are shown in the comparative plots of FIG. 8 and FIG. 9. The normalized radiation patterns of the microstrip patch antennas in the meandered-line configuration versus the continuous ground plane base line configuration are depicted in comparative plots of FIG. 10. For clarity, only the copolarized fields are shown because the cross-polarized fields exhibited no major changes.

The empirically measured parameters and patterns are in good agreement with the simulations. The $S_{21}$ parameter decreased from its maximum value of −26 dB to −31 dB in the fabricated base configuration and fabricated meandered-line configuration, respectively. This decrease in coupling appears to correlate with the increased radiation in the backplane indicated in the measured parameters table, Table II, which follows:

TABLE II

| | H-Plane | | E-Plane | |
|---|---|---|---|---|
| | Peak Gain | Peak Backplane Gain | Peak Gain | Peak Backplane Gain |
| Fab. Base Port 1 | 5.99 dBi | −18.95 dBi | 6.51 dBi | −12.27 dBi |
| Sim. Base Port 1 | 6.56 dBi | −12.92 dBi | 6.56 dBi | −9.59 dBi |
| Fab. FSS Port 1 | 6.61 dBi | −8.36 dBi | 6.35 dBi | −8.33 dBi |
| Sim. FSS Port 1 | 6.37 dBi | −9.09 dBi | 6.39 dBi | −7.22 dBi |
| Fab. Base Port 2 | 6.24 dBi | −12.97 dBi | 5.83 dBi | −12.29 dBi |
| Sim. Base Port 2 | 6.68 dBi | −14.29 dBi | 6.68 dBi | −11.09 dBi |
| Fab. FSS Port 2 | 6.68 dBi | −7.22 dBi | 6.97 dBi | −6.06 dBi |
| Sim. FSS Port 2 | 6.40 dBi | −8.59 dBi | 6.42 dBi | −7.09 dBi |

Observed deviations are most likely the result of impedance mismatches created as a result of fabrication imprecision.

Any theory, mechanism of operation, proof, experiment, result, simulation, or finding stated herein is meant to further enhance understanding of the present invention and is not intended to make the present invention in any way dependent upon such theory, mechanism of operation, proof, experiment, result, simulation, or finding. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow. In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary. While the invention has been illustrated and described in detail in the drawings and foregoing description, the same is to be considered as illustrative and not restrictive in character, it being understood that only the selected embodiments have been shown and described and that all changes, modifications and equivalents that come within the spirit of the invention as defined herein or by any of the following claims are desired to be protected.

What is claimed is:

1. An apparatus comprising a wireless communication device including:

a dielectric substrate with a first side opposite a second side;

two or more antenna elements spaced apart from one another along the first side of the substrate; and an electrical ground region carried on the second side of the substrate, the electrical ground region including a first electrically conductive area opposite a first one of the antenna elements, a second electrically conductive area opposite a second one of the antenna elements, and an electrically conductive meander line structure interconnecting the first area and the second area, the meander line structure extending along the second side of the substrate opposite a portion of the first side positioned between the first one of the antenna elements and the second one of the antenna elements.

2. The apparatus of claim 1, wherein:

the antenna elements each correspond to a patch antenna coupled to the first side of the substrate;

the electrical ground region is generally planar; and the first area, the second area and the meander line structure are defined by a layer of electrically conductive material.

3. The apparatus of claim 1, wherein the meander line structure includes a number of legs defining a pathway with a number of turns and the meander line structure includes a number of dielectric voids in the ground region to separate the legs from one another.

4. The apparatus of claim 3, wherein the legs define a number of switchbacks and the meander line structure is one of a number of meander line portions of the ground region coupled to the first area and the second area to provide electrical continuity therewith.

5. The apparatus of claim 1, further comprising means for communicating with signals of a selected wavelength through the antenna elements, the meander line structure being sized to correspond to approximately one half of the wavelength.

6. The apparatus of claim 1, wherein the meander line structure is one of a number of meander lines electrically connected to the first area and the second area, the meander lines each corresponding to a boustrophedonic pathway with a plurality of elongate elements interdigitated with a plurality of slots.

7. A method, comprising:

operating a wireless communication device including a first antenna, a second antenna spaced apart from the first antenna, and a dielectric substrate, the substrate including a first electrically conductive ground area along the substrate opposite the first antenna and a second electrically conductive ground area along the substrate opposite the second antenna; and suppressing signal coupling between the first antenna and the second antenna by connecting the first area and the second area to an electrical ground structure to provide electrical continuity therewith, the structure extending along the substrate opposite a region between the first antenna and the second antenna, the structure defining a meander line with multiple legs.

8. The method of claim 7, which includes separating the legs of the meander line from one to the next with a corresponding dielectric slot.

9. The method of claim 7, which includes connecting several meander line structures coupled to the first area and the second area.

10. The method of claim 7, which includes sizing the legs relative to a communication signal wavelength.

11. The method of claim 7, which includes providing each of the first antenna and the second antenna as a patch type.

12. The method of claim 7, which includes forming the first area, the second area, and the structure with a layer of electrically conductive material deposited on the substrate.

13. A method, comprising:

providing a dielectric substrate for an electronic device;

defining an electrical ground region on a first side of the dielectric substrate with a first contiguous area and a second contiguous area;

defining a number of dielectric slots along the first side of the substrate between the first area and the second area, the slots being separated from one to the next by a corresponding electrically conductive, grounded pathway in electrical continuity with the first area and the second area; and positioning the slots and the corresponding grounded pathway to suppress surface wave coupling between the first area and the second area.

14. The method of claim 13, which includes defining a first antenna on a second side of the substrate opposite the first area and a second antenna on the second side of the substrate opposite the second area.

15. The method of claim 14, wherein the positioning includes placing the slots opposite an area along the second side of the substrate between the first antenna and the second antenna.

16. The method of claim 13, which includes providing the corresponding grounded pathway with a meander line shape including a number of legs, the legs defining at least a portion of the slots.

17. The method of claim 13, which includes providing a number of meander line structures to electromagnetically couple the first area and the second area, the electrically conductive pathway corresponding to one of the meander line structures.

18. The method of claim 13, wherein the defining of the electrical ground region includes depositing an electrically conductive layer on the first side of the substrate, and the defining of the slots includes providing a number of voids in the layer, the voids each corresponding to a respective one of the slots.

19. An apparatus comprising: a wireless communication device including:

a dielectric substrate;

an electrical ground region defined on a first side of the substrate, the ground region defining a first contiguous electrically conductive area, a second contiguous electrically conductive area, and a number of spaced apart electrical ground interconnecting portions to decrease coupling of surface waves traveling along the substrate, each respective one of the portions including:

an electrical connection to the first area and an electrical connection to the second area to provide electrical continuity therewith;

several connected legs to define a pathway with a number of tums between the first area and the second area; and a number of dielectric voids in the ground region to separate the legs from one to the next.

20. The apparatus of claim 19, further comprising a first antenna opposite the first area and a second antenna opposite the second area.

21. The apparatus of claim 20, further comprising means for receiving and transmitting signals through the first antenna and the second antenna.

22. The apparatus of claim 20, wherein the first antenna and the second antenna are each of a patch type carried on a second side of the substrate.

23. The apparatus of claim 19, wherein the pathway corresponds to a meander line.

24. The apparatus of claim 19, wherein the legs are each sized relative to approximately one half of a communication signal wavelength.

25. The apparatus of claim 19, wherein the ground region is comprised of an electrically conductive layer connected to the first side of the substrate.

* * * * *

UNITED STATES PATENT AND TRADEMARK OFFICE

CERTIFICATE OF CORRECTION

PATENT NO. : 7,701,395 B2
APPLICATION NO. : 11/710867
DATED : April 20, 2010
INVENTOR(S) : Alvey et al.

It is certified that error appears in the above-identified patent and that said Letters Patent is hereby corrected as shown below:

Col. 10, Line 44: Replace “tums” with --turns--.

Signed and Sealed this
Twenty-second Day of March, 2011

David J. Kappos

David J. Kappos
*Director of the United States Patent and Trademark Office*